United States Patent [19]

Freyn

[11] 4,184,468

[45] Jan. 22, 1980

[54] DECOMPRESSION DEVICE FOR INTERNAL COMBUSTION ENGINES

[75] Inventor: Fritz Freyn, Graz, Austria

[73] Assignee: Hans List, Graz, Austria

[21] Appl. No.: 916,546

[22] Filed: Jun. 19, 1978

[30] Foreign Application Priority Data

Jun. 23, 1977 [AT] Austria ..... 4459/77

[51] Int. Cl.[2] ..... F01L 13/08; F02H 53/06

[52] U.S. Cl. ..... 123/182; 123/109; 74/569

[58] Field of Search ..... 123/182, 109, 112; 74/569

[56] References Cited

U.S. PATENT DOCUMENTS

| | | | |
|---|---|---|---|
| 3,057,336 | 10/1962 | Hatz, Jr. | 123/182 |
| 3,146,772 | 9/1964 | Hatz, Jr. | 123/182 |
| 3,319,619 | 5/1967 | Neuer | 123/182 |
| 3,548,799 | 12/1970 | Lang | 123/182 |

FOREIGN PATENT DOCUMENTS

| | | | |
|---|---|---|---|
| 451428 | 8/1936 | United Kingdom | 123/182 |

*Primary Examiner*—Charles J. Myhre
*Assistant Examiner*—M. Moy
*Attorney, Agent, or Firm*—Watson, Cole, Grindle & Watson

[57] ABSTRACT

A decompression device for internal combustion engines to enable easier starting, comprising a camshaft operated balancer acting on a valve of the engine, a rotatable decompression cam acting on the balancer, and a rotation device to rotate the decompression cam during starting, the balancer and the rotation device being designed to enable minimum space requirement and symmetrical motion of and forces on the decompression mechanism.

4 Claims, 4 Drawing Figures

DECOMPRESSION DEVICE FOR INTERNAL COMBUSTION ENGINES

BACKGROUND OF THE INVENTION

The invention relates to a decompression device for internal combustion engines to suspend and automatically turn on again compression after several rotations of the engine during the engine start by way of lifting a valve of the engine for a certain time, said decompression device comprising a camshaft operated balancer acting on said valve, a decompression cam rotatable on its own axis and acting on the balancer, and a rotating device to rotate the decompression cam, said rotation device consisting of a ratchet rotatably secured to the balancer and a ratchet wheel with a notchless segment in engagement with the ratchet and rigidly connected with the decompression cam, the axis of the decompression cam being arranged parallel to the axis of the balancer.

DESCRIPTION OF THE PRIOR ART

The British Patent Specification No. 451 428 discloses a decompression device of the kind referred to which acts directly on one of the rocker arms of the valves of the engine. Said decompression device consists of a decompression cam acting on the rocker arm and being rotatable on its own axis and a rotation device to rotate the decompression cam. Said rotation device comprises a ratchet which is pivoted on one side of the rocker arm and a ratchet wheel which can be brought into engagement with the ratchet and which is rigidly connected to the decompression cam. The decompression cam acts either directly on the rocker arm, whereby the ratchet on the side of the rocker arm meshes with the ratchet wheel arranged in a corresponding plane, or the ratchet wheel is operated by a ratchet pivoted on one side of the rocker arm in the range of the valve clearance setscrew and being loaded by a spiral spring, whereby at one side of the rocker arm an additional lever is moulded on which meshes with the decompression cam. Both embodiments have the essential disadvantage that symmetry of motion of and forces upon the decompression mechanism is not attainable. Besides of this the space requirement of the decompression device in direction of the axis of rotation of the rocker arm is enlarged due to the lateral pivoting of the ratchet or the additional lever respectively at the rocker arm. When using such a device at engine designs having the camshaft arranged in front of the cylinder and the balancers behind the camshaft gear wheel a greater distance between the cylinder and the camshaft gear wheel is required to position the decompression device. This results in a bigger engine length accompanied by the disadvantages of raised space requirement, higher weight, and higher production costs.

SUMMARY OF THE INVENTION

It is the aim of the invention to provide a decompression device which permits full symmetry of motion and forces of the mechanism and the longitudinal extension of which is as small as possible, so that enlargement of the engine size and weight by use of the decompression device is not necessary.

An advantageous solution of this problem is gained when, according to the invention, the balancer has a reduced breadth in the range of the rotation device, said reduced breadth being formed by two substantially equal dimensioned recesses and when further a second ratchet wheel of the same kind is provided symmetrically to the decompression cam and also secured rigidly to the latter and when the ratchet embraces the balancer on both sides at its narrow part.

By this construction the essential advantage of symmetrical design of the balancer and the rotation device is attained, simultaneously maintaining the advantage of little space requirement. The gained symmetry of motion and forces of the decompression mechanism prevents one-sided load and end pressure, easy motion is guaranteed, and premature and undue wear is avoided. Generally all masses being involved with the valve drive should be kept low and from this point of view the reduced breadth of the balancer is also advantageous. Due to the preferably one-piece-design of the balancer costs for production and assembly can be reduced. A further advantage results from the fact that the balancer extends between the two ratchet wheels thereby preventing axial movements of the decompression shaft so that further locking measures are not necessary.

According to a further feature of the invention the total breadth of the decompression cam and the ratchet wheels and the breadth of the ratchet is at most equal to the maximal breadth of the balancer. This is an especially space saving design because no extra space in axial direction of the balancer for the rotation device is required.

Furthermore the rotation device with the decompression cam may be located in regard to the axis of rotation of the balancer opposite of the engagement point provided at the balancer for operation of the valve. Especially at engines with push rod operated valves and at small engines with narrowly arranged push rods provision of the decompression cam support or the decompression shaft support respectively at the crankcase is easier and freedom of design of the ball cup for the valve push rod is not afflicted. The decompression shaft may be conveyed through a part of the camshaft wheel housing protruding over the proper contour of the engine and can be beared in the housing wall without making necessary a special lug at the crankcase like normally required. Also drilling of the hole for the decompression shaft bearing is essentially more simple.

According to a further feature of the invention between the hub of the balancer and the ratchet is provided a compression spring. The ratchet is constantly pressed against the notches at the ratchet wheels, yielding of the ratchet against the force of the spring being possible.

It is a special merit of the invention that full freedom regarding the location of the decompression device is maintained. Installation at the balancer within the camshaft gear wheel housing as well as at the rocker box above the valves is possible. Also direct action of the decompression cam on a conventional balancer or rocker arm is possible without requiring a special design of the balancer or rocker arm, e.g. like described in the following exemplary embodiment.

DESCRIPTION OF THE DRAWINGS

The invention will be hereinafter described more specifically with reference to the accompanying drawings, wherein.

DESCRIPTION OF THE PREFERRED EMBODIMENT

Figure 1:
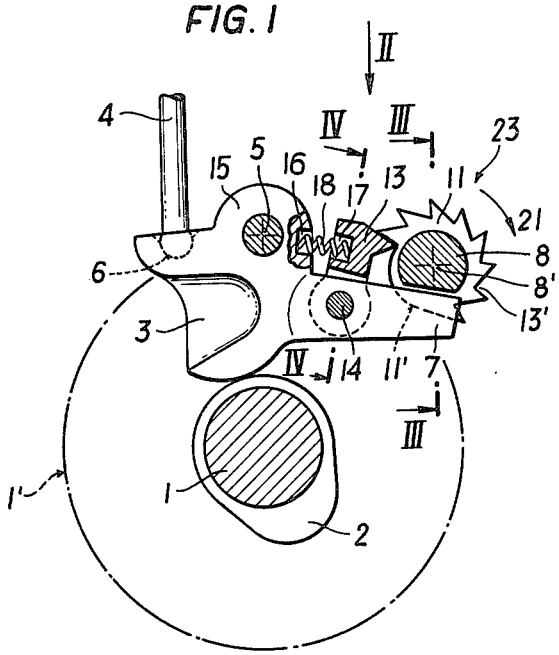
FIG. 1 is a partial section of the decompression device according to the invention, FIG. 2 a plan view according to arrow II of FIG. 1, FIG. 3 a section through the decompression shaft bearing in the crankcase according to line III—III of FIG. 1.
Figure 2:
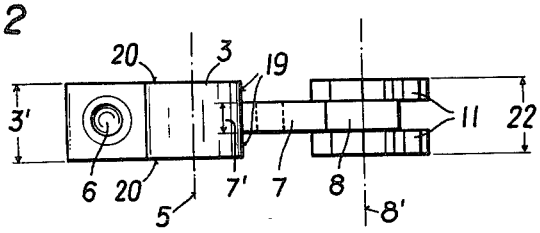
Figure 3:
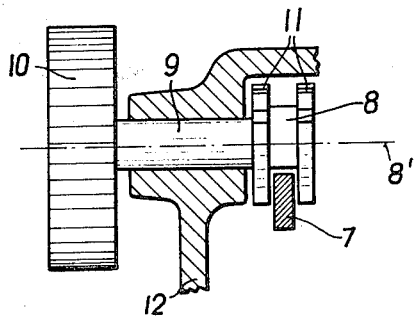
Figure 4:
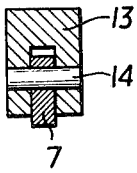
FIG. 4 is section of a detail of the invention according to line IV—IV of FIG. 1.

On camshaft 1, driven by camshaft wheel 1', cam 2 is provided acting on balancer 3 which on its turn acts on a (not shown) valve of the engine by means of push rod 4, as shown in FIG. 2, balancer 3 is in regard to its axis of rotation 5 opposite of the engagement point 6 formed as to have an additional lever 7 which has a reduced breadth 7' in regard to the breadth 3' of the balancer 3 itself. For operation of the additional lever 7 decompression cam 8 is provided on decompression shaft 9 to which handle 10 is secured.

At the decompression shaft 9 is further provided on both sides of the decompression cam 8 each a ratchet wheel 11 rigidly connected to the decompression cam 8 and each having a corresponding notchless segment 11'. The additional lever 7 extends between the ratchet wheels 11 thereby leaving a small distance between cam 8 and lever 7 when the decompression device is not operated. Decompression shaft 9 is beared rotatably in the crankcase 12.

On the additional lever 7 a partially slotted ratchet 13 is mounted between the axis of rotation 5 of the balancer 3 and the decompression cam 8 in a manner as to embrace the lever 7 on both sides. Ratchet 13 is pivoted to the additional lever 7 by means of pin 14. Between the hub 15 of balancer 3 and ratchet 13 a compression spring 18 is supported by suitable bores 16, 17 which presses the ratchet 13 against the ratchet wheels 11.

The ratchet wheels 11 and the ratchet 13 form together a rotation device 23 for the decompression cam 8. The reduced breadth 7' of the additional lever 7 is formed by two equally dimensioned recesses 19 set back from the plane surfaces 20 of the lever 7 in order to gain symmetry of the lever 7 and the ratchet mechanism.

The total breadth 22 of the decompression cam 8 and the ratchet wheels 11 amounts at most to the maximal breadth 3' of the balancer 3.

Operation of the decompression device is as follows: Before starting the engine decompression cam 8 with ratchet wheels 11 is turned by hand with handle 10 in the sense of arrow 21 beyond the notchless segment 11' so that cam 8 lifts the balancer 3 by means of the additional lever 7 and further the not shown engine valve over push rod 4. The ratchet 13 clicks into one of the notches of the ratchet wheels 11 and the valve stays a little open. When rotating the engine for start no compression occurs and starting is made easier. The decompression cam 8 is dimensioned in a manner that balancer 3 is not fully lifted from the cam 2, therefore balancer 3 makes a rocking movement on its axis 5 at every revolution of camshaft 1. The ratchet 13 pivoted to lever 7 is also moved downwards thereby flexibly clicking into the next notch on the ratchet wheels 11. At the following shutting movement of the valve and the corresponding upward movement of the lever 7 with the ratchet 13 the decompression cam 8 is turned by means of the ratchet wheels 11 further in the sense of arrow 21. This procedure is repeated until the notchless segment 11' of the ratchet wheels 11 is opposite of the ratchet. In this position the zero-position of the decompression cam 8 is reached again and the decompression device is out of charge and the engine valve can shut again. Further rotation of the decompression cam 8 due to the rocking movement of the balancer 3 does not occur because the ratchet 13 cannot engage with the notchless segment 11' of the ratchet wheels 11.

I claim:

1. A decompression device for internal combustion engines to suspend and automatically turn on again compression after several rotations of the engine during the engine start by way of lifting a valve of the engine for a certain time, said compression device comprising a camshaft operated balancer acting on said valve, a decompression cam rotatable on its own axis and acting on the balancer, and a rotation device to rotate the decompression cam, said rotation device consisting of a ratchet rotatably secured to the balancer and a ratchet wheel with a notchless segment in engagement with the ratchet and rigidly connected to the decompression cam, the axis of the decompression cam being arranged parallel to the axis of the balancer, the balancer having a reduced breadth in the range of the rotation device, said reduced breadth being formed by two substantially equal dimensioned recesses, further being provided a second ratchet wheel of the same kind symmetrically to the decompression cam and also secured rigidly to the latter, the ratchet embracing the balancer on both sides at its narrow part.

2. A decompression device according to claim 1 the total breadth of the decompression cam and the ratchet wheels and the breadth of the ratchet being at most equal to the maximal breadth of the balancer.

3. A decompression device according to claim 1 the rotation device with the decompression cam being located in regard to the axis of rotation of the balancer opposite of the engagement point provided at the balancer for operation of the valve.

4. A decompression device according to claim 1 between the hub of the balancer and the ratchet being provided a compression spring.

* * * * *